US006718964B1

(12) United States Patent
Graf

(10) Patent No.: US 6,718,964 B1
(45) Date of Patent: Apr. 13, 2004

(54) ARCHERY BOW STABILIZER

(75) Inventor: Stephen C. Graf, Pittsboro, NC (US)

(73) Assignee: Carolina Archery Products, Hillsborough, NC (US)

( * ) Notice: Subject to any disclaimer, the term of this patent is extended or adjusted under 35 U.S.C. 154(b) by 0 days.

(21) Appl. No.: 09/946,301

(22) Filed: Sep. 4, 2001

(51) Int. Cl.[7] ..... F41B 5/20
(52) U.S. Cl. ..... 124/89
(58) Field of Search ..... 124/89

(56) References Cited

U.S. PATENT DOCUMENTS 3,524,441 A 8/1970 Jeffery
4,135,486 A 1/1979 Enomoto
4,936,283 A 6/1990 Izuta
5,090,396 A 2/1992 Bickel et al.
5,273,022 A 12/1993 Leven
5,339,793 A * 8/1994 Findley ..... 124/89
5,584,282 A 12/1996 McDonald
5,611,325 A 3/1997 Kudlacek
6,431,163 B1 * 8/2002 Chipman ..... 124/89

OTHER PUBLICATIONS

Lancaster Archery Supply Catelog, pp. 65–72.

* cited by examiner

*Primary Examiner*—John A. Ricci
(74) *Attorney, Agent, or Firm*—Kilpatrick Stockton LLP

(57) ABSTRACT

An archery bow stabilizer is formed from a base unit connectable to an archery bow, an elongated damping element connected to the base unit at a first end, a plurality of recessed flutes extend lengthwise along the damping element, and a plurality of elongated linear spring rods connected to the based unit and parallel to the damping element. The rods are configured to fit within the recessed flutes to provide contact between the rods and the damping element.

26 Claims, 7 Drawing Sheets

FIG. 7
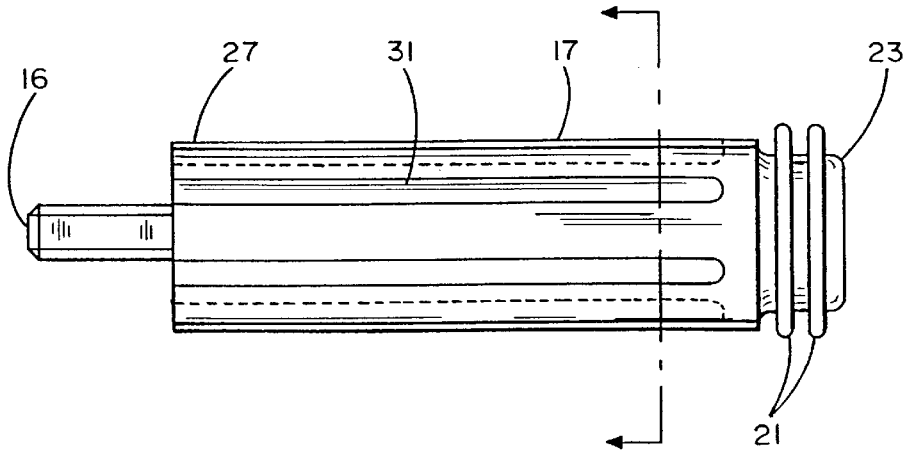
FIG. 7
FIG. 6
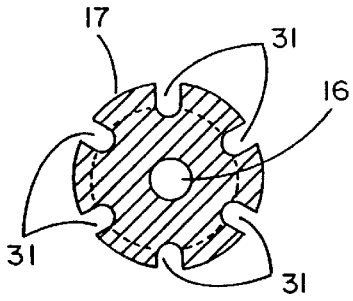
FIG. 7

ARCHERY BOW STABILIZER

BACKGROUND OF THE INVENTION

1. Field of the Invention

This invention relates to archery bow stabilizers for reducing vibrations of the bow to produce more accurate shooting.

2. Background

When an arrow is shot from an archery bow, the bow vibrates. The vibrational movement of the bow inhibits accuracy in shooting, causes physical discomfort to the shooter's hand and arm, and causes wear and tear on the bow and string. A bow stabilizer device may be attached to the bow to dampen or absorb vibrational energy from the bow such that the bow motion is minimized.

As will be better understood by the following discussion, stabilizers essentially function as a shock absorber and provide inertial stability to the bow assembly. A shock absorber can be thought of as a combination of a damping element (or "damper") and a spring element. The spring captures energy from the bow and delivers it to the damper. The damper absorbs or dissipates energy delivered from the spring. The damper may also capture and absorb energy through its direct contact with the bow.

An oscillating system stores energy by vibrating at a characteristic resonance frequency. An oscillating system may also vibrate at harmonics of the resonance frequency, i.e., twice the resonance frequency, four times the resonance frequency, etc. The resonant frequency is proportionate to a constant commonly referred to as the spring constant or spring coefficient. The spring coefficient is a measurement of the stiffness of the system. Numerically, the spring coefficient is equal to the force required to produce a unit of change in length from the equilibrium position, and is generally expressed in Newtons per meter or pounds per foot. An oscillating system also has a damping factor associated therewith which dampens or diminishes the amplitude of the oscillations over time.

When an arrow is shot, the bow becomes an oscillating system, which, like other oscillating systems, has an inherent resonant frequency at which it vibrates. Likewise, archery bow stabilizers are oscillating systems with an inherent resonant frequency associated therewith. Stabilizers typically function in a manner analogous to a mass attached to a spring on a surface which has a damping factor caused by friction between the mass and the surface. The spring transfers motional energy to the mass, and the system oscillates. The mass acts as a damper because it dissipates energy due to friction between the mass and the surface.

In the same manner, bow stabilizers generally have a spring element and a damping element. Oscillations in the bow drive oscillations in the spring element of the stabilizer. The spring element transfers energy to the damping element, which has a damping factor associated therewith that is higher than the damping factor of the spring or bow for absorbing energy. Thus, bow stabilizers absorb or dissipate energy by transferring energy from the bow to the damper through a spring element. The damper/spring stabilizer system has an inherent resonant frequency which is referred to herein as a damping frequency.

An optimum amount of energy is absorbed when the inherent resonate frequency of the system being damped is equal to the damping frequency of the damper/spring shock absorber. This is commonly referred to as "critically damped." The damping frequency of a shock absorber that has a spring and a damper is proportional to the product of the spring coefficient associated with the spring and the spring coefficient associated with the damper.

Conventionally, there are three basic types of bow stabilizers. Each can be understood as a damper/spring shock absorber.

One type of bow stabilizer is a metal tube surrounding a damping fluid or gel. The metal tube functions as a spring of almost infinite stiffness, i.e., with an almost infinite spring coefficient. The fluid or gel is the damper and absorbs energy from the metal tube. The fluid or gel may also contain a piston that moves in the fluid to further dissipate energy. Because the "spring" in such a system has a nearly infinite spring coefficient, the natural frequency of the stabilizer is higher than the resonate frequency of the system being damped. Therefore, the system is underdamped.

Another type of bow stabilizer is an elastomeric element connected to a weight. In such a system, the elastomeric element functions as both a damper and a spring. Generally, the spring coefficient in this type of bow stabilizer is low, making the natural frequency of the stabilizer less than the natural frequency of the bow, and thus, the system is overdamped.

A third type of bow stabilizer is a rod and mass system. Rod and mass stabilizers use a system of movable weights to tune the stabilizer resonant frequency to that of the natural frequency of the system. The rods act as a spring to transfer the energy of the bow to the weights. The rods are fixed at both ends, and therefore, the frequency of the vibrations are proportional to the length of the rods and various harmonics thereof. The weights function both as a damper to absorb the energy and as a tuner. The weights may be moved to various positions along the rod. If the weight is placed at an antinode of a resonant frequency of the rod, a maximum amount of energy can be absorbed. This type of bow stabilizer most closely approximates the natural frequency of the system to attain critical damping. However, it is often difficult to tune the stabilizer for critical damping. In addition, because the weights must be moveable to tune the stabilizer, the size of the weight is limited. The damping factor is a function of the mass of the damping material. Thus, most tunable rod and mass configurations do not allow for enough damping material to adequately absorb the energy once it is captured by the stabilizer.

These and other problems are avoided and numerous advantages are provided by the apparatus described herein.

BRIEF SUMMARY OF THE INVENTION

The present invention provides an archery bow stabilizer for damping bow vibrations. When a bow is shot, vibrations occur in the bow and string. These vibrations inhibit accuracy in shooting, cause discomfort in the hand and arm of the shooter, and causes wear and tear on the bow and string. The present invention dampens vibrations to increase accuracy in shooting, reduces shooter discomfort, and prolongs the lifetime of the bow and string. In addition, the present invention provides inertial stability to the bow and string assembly.

In an embodiment, the spring element is fixed at an end proximate to the bow, but is not fixed on its distal end. Because the spring element is not fixed at one end, it communicates vibrational energy in a range of frequencies to a damping element, and tuning is not required. The energy is dissipated by the damping element to minimize vibrations and motion in the bow. Because tuning is not required, the damping element is not movable and may extend the entire length of or even longer than the spring elements. Therefore, a larger damping element is provided for more efficiently damping bow motion.

In accordance with the invention, an archery bow stabilizer is disclosed. In an embodiment, an elongated damping element with a first and second end is connectable to an archery bow. A plurality of elongated linear spring rods is connected to the damping element at the first end, and a plurality of flutes connects the damping element to the rods.

When an archery bow is shot, it stores energy by vibrating at a characteristic resonance frequency. The vibrations of the bow are transferred to the elongated linear spring rods, which are configured to vibrate in a range of frequencies because they are fixed at only one end. The linear spring rods, which are in close contact with the damping element, transfer vibrational energy to the damping element where the energy is dissipated.

In another aspect of the invention, the stabilizer includes a base unit that is connectable to an archery bow. An elongated damping element which has a first and second end is connected to the base unit at its first end. A plurality of recessed flutes extends lengthwise along the damping element from the first end towards the second end. A plurality of elongated linear spring rods is connected to the base unit and parallel to the damping element. The rods are configured to fit within the recessed flutes.

Preferably, the damping element extends beyond the length of the rods. The stabilizer preferably includes one or more ribs that extend radially around the second end of the damping element. The stabilizer may also have an absorber mount for connecting the first end of the damping element to the base unit.

Preferably, the damping element is made from an elastomeric material, the rods are made from steel, and the base unit and absorber mount are made from aluminum. More preferably, the damping element is made from rubber.

Because the rods vibrate in a range of frequencies, it is not necessary to tune the stabilizer. The configuration of the damping element, which extends parallel to the spring elements, provides for a larger, more massive damping element for more efficient energy damping. Additional damping is provided by the portion of the damping element that extends beyond the length of the rods. Still more damping is provided by the ribs which extend radially around the second end of the damping element. These and other advantages will become apparent to those of ordinary skill in the art with reference to the detailed description and drawings.

BRIEF SUMMARY OF THE DRAWINGS

FIG. 6 is a side view of a damping element and recessed flutes.

FIG. 7 is a cross sectional view of a damping element and recessed flutes.

DETAILED DESCRIPTION OF THE INVENTION

Figure 1:
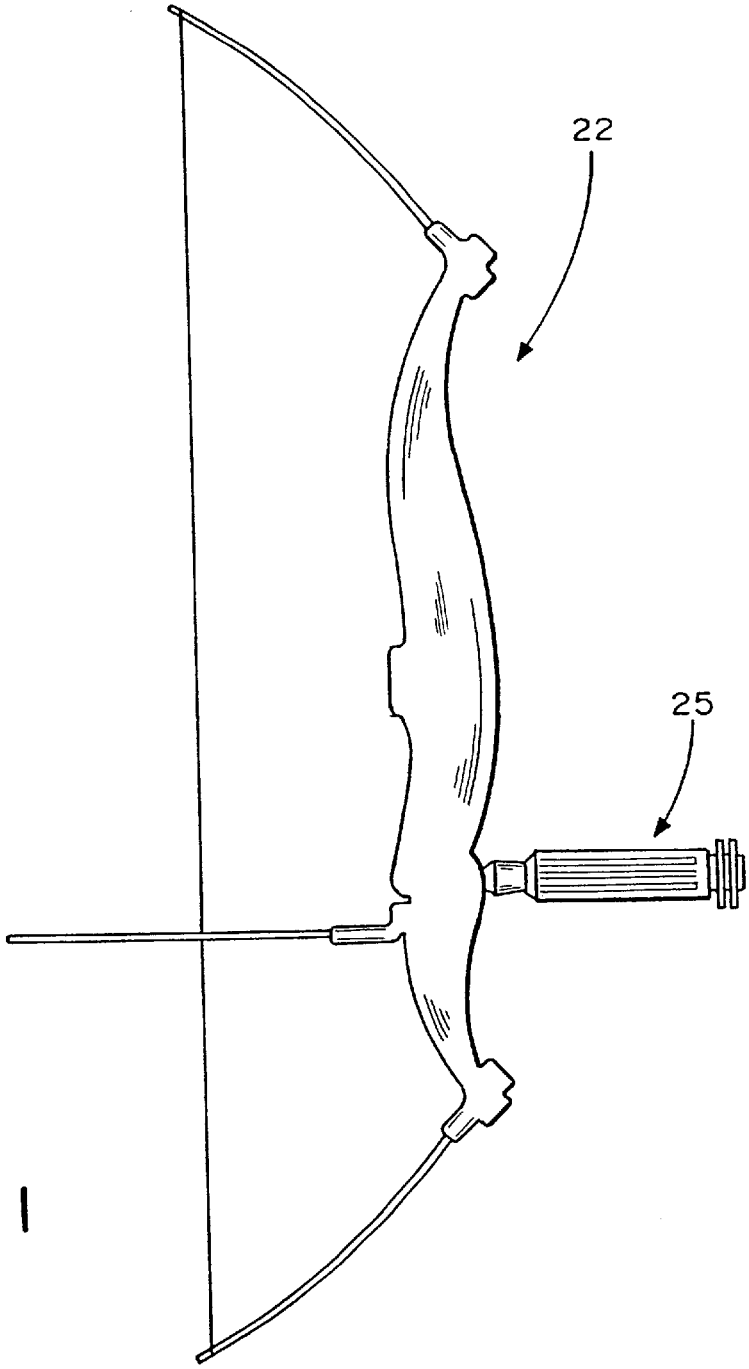
FIG. 1 is a side view of a bow stabilizer attached to a bow.

FIG. 1 shows a side view of an embodiment of an archery bow stabilizer 25 attached to a bow and arrow assembly 22.

Figure 2:
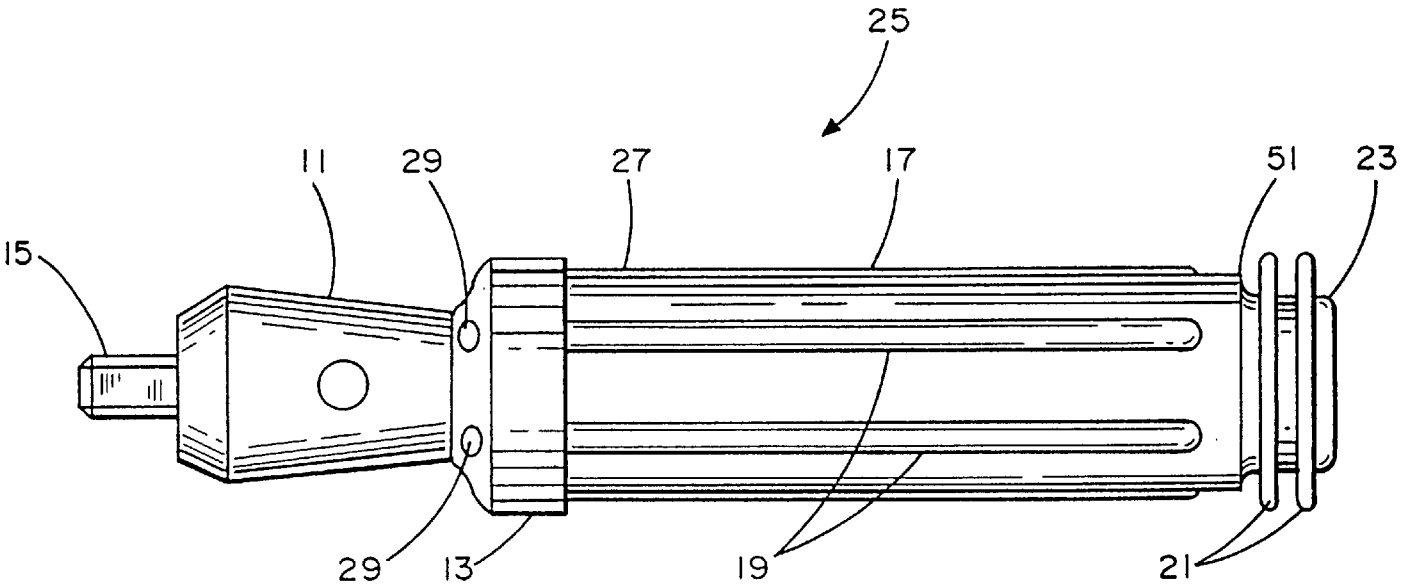
FIG. 2 is a side view of a bow stabilizer.

Referring to FIG. 2, a side view schematic of an embodiment of the present invention, an archery bow stabilizer 25 is shown. In the embodiment, the base unit 11 is connectable to an archery bow by a first stud 15. Bow stabilizers are typically affixed to the front face of the bow, extending away from the shooter. Preferably, the base unit 11 is made from a strong, light-weight, rigid material such as aluminum.

The elongated damping element 17 has a first end 27 and a second end 23, and is connected to the base unit 11 at the first end 27. The damping element 17 is connected to the base unit 11 by an absorber mount 13. Alternatively, as will be better understood by the discussion of FIG. 9, the base unit 11 may be omitted, and the absorber mount 13 may be configured to be connectable to the damping element 17 and the bow.

The stabilizer includes a plurality of elongated linear spring rods 19 that is connected to the absorber mount 13 and positioned parallel to the damping element 17. Preferably, the rods 19 are connected to the base unit 11 by the absorber mount 13. The absorber mount 13 includes a plurality of recessed portions 29 in which the rods 19 are inserted and secured. Preferably, the absorber mount 13 is made from a strong, light-weight, rigid material such as aluminum.

The damping element 17 includes a plurality of recessed flutes (shown in FIGS. 6 and 7 discussed below). The rods 19 are configured to fit within the recessed flutes. Although the damping element 17 is illustrated as a solid cylindrical shaped element, other shapes are possible. In addition, the damping element 17 could be a hollow element, or the damping element 17 could be a hollow element filled with a liquid or powder.

The linear spring rods 19 function as "springs" which transfer energy to the damping element 17. The rods 19 are in close contact with the damping element 17, and communicate vibrational energy to the damping element 17 in the same manner as a spring/damper shock absorber described in the Background of the Invention. The damping element 17 captures and absorbs energy from the rods 19. The rods 19 are preferably made from a durable, hard material such as steel. The rods 19 are fixed at the end closest to the bow. Because the rods are not fixed at the distal end, the rods 19 are free to vibrate over a wide range of frequencies, and therefore, tuning is not required. Preferably, there are between four and six rods 19. More preferably, there are six rods 19.

The damping element 17 is made from an elastomeric material. Preferably, the elastomeric material is rubber. More preferably, the elastomeric material is rubber having a durometer of between 30 and 40 on a standard Shore™ A durometer scale. Most preferably, the elastomeric material is rubber having a durometer of 40 on a standard Shore™ A durometer scale.

The configuration described herein allows for a larger, and thus, more efficient, damping element than prior rod and mass type bow stabilizers. The damping element 17 is not movable, and therefore, the damping element 17 may extend substantially the entire length of the stabilizer, which allows for a larger damping element and maximizes the energy dissipated. The rods 19 are not fixed at the end distal to the bow, and thus, vibrate at a wide range of frequencies. The rods 19 are in close contact with the damping element 17 to maximize the contact between the rods 19 and the damping element 17. In FIG. 2, the rods 19 are shown placed in recessed flutes, described in greater detail in FIGS. 6 and 7. However, contact between the rods 19 and the damping element 17 can be accomplished in other alternative configurations. For example, the rods 19 could be embedded into the damping element 17. Because of close contact with the damping element 17, the rods 19, which function as springs, communicate a maximum amount of energy to the damping element 17.

The damping element 17 has a second end 23 that preferably extends beyond the length of the rods 19. At least one rib 21 extends radially around the second end 23 of the damping element 17.

A bow assembly vibrates in all directions. Therefore, the elements of the stabilizer 25 are designed to absorb and dampen vibrations in all three dimensions. The rods 19 generally absorb vibrational energy perpendicular to the stabilizer. The second end 23 of the damping element 19 extending beyond the length of the rods 19 absorbs vibrational energy primarily in the direction perpendicular to the stabilizer and parallel to the bow as shown in FIG. 1. The radial ribs 21 absorb vibrational energy primarily in the direction parallel to the damping element, i.e., along the center axis of the damping element.

Although the ribs 21 are shown as radial protrusions around the second end 23, other alternative protrusions or projection elements may be substituted for the ribs 23. The projection element may have numerous shapes such as a disk, a knob, or a hammer shape.

Figure 3A:
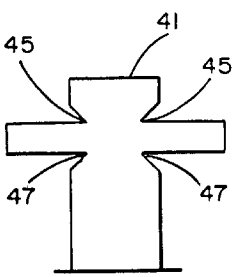
FIGS. 3A–3L are side views of alternative embodiments of one end of a damping element.
Figure 3B:
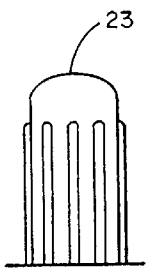
Figure 3C:
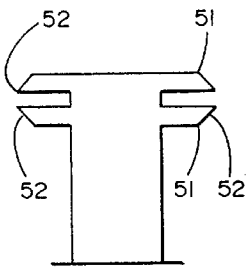
Figure 3D:
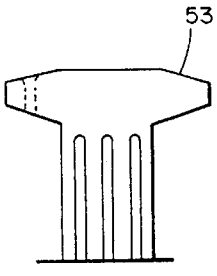
Figure 3E:
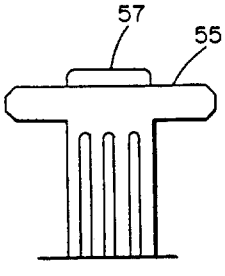
Figure 3F:
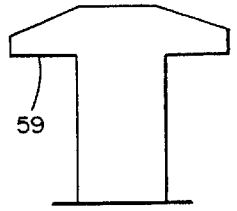
Figure 3G:
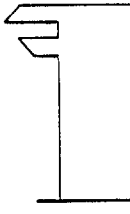
Figure 3H:
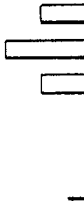
Figure 3I:
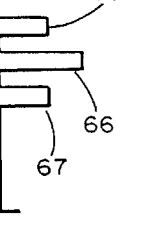
Figure 3K:
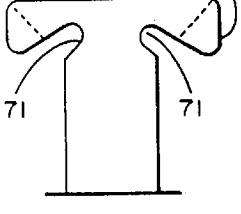
Figure 3L:
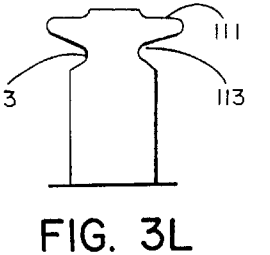
Figure 3J:
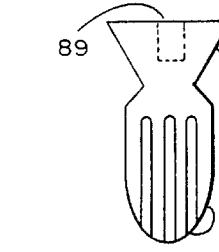
Figure 5F:
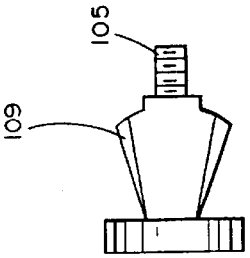
FIGS. 5B–5F are side views of alternative embodiments of a base unit.
Figure 5E:
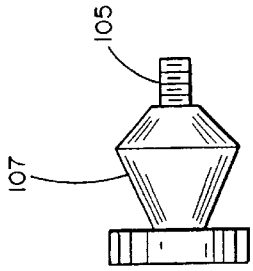

Examples of alternative projection elements incorporated into the second end are shown in FIGS. 3A–3L in a cross sectional view. FIG. 3A shows a projection element that has a knob 41 and a radial disk shaped element 43. FIG. 3B shows the second end 23 without a projection element. Notched portions 45 and 47 are above and below the disk 43. FIG. 3C shows two disk shaped projection elements 51 with angled tips 52. FIG. 3D shows a disk shaped projection element 53 with tapered ends. FIG. 3E has a disk shaped element 55 with squared ends and a flat knob 57. FIG. 3F shows a disk shaped element 59 that tapers downward. FIG. 3G has a top disk shaped element 61 and a bottom disk shaped element 63. The bottom disk 63 is smaller than the top disk 61. FIG. 3H shows three disk shaped projection elements 65, 66, and 67, where the middle element 66 is larger than the top element 65 and the bottom element 67. FIG. 3I shows a disk shaped projection element 69 with circular tapered notches 71. FIG. 3J shows a cone shaped projection element 87 with a notch 89 on the top of the cone 87. FIG. 3K shows a disk shaped projection element 97 with square ends, and FIG. 3L shows a disk shaped projection element 111 with rounded ends and circular notches 113 below the disk 111.

Figure 4A:
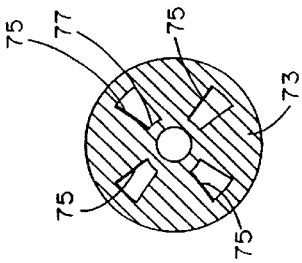
FIGS. 4A–4C are front views of alternative embodiments of one end of a damping element.
Figure 4C:
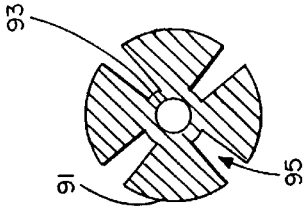
Figure 4B:
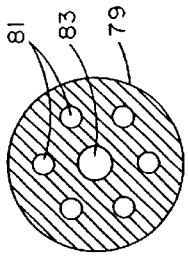

FIGS. 4A–4C show the top view of optional projection elements. FIG. 4A shows a wheel shaped projection element with spokes 75 and an outer circular portion 73 and an inner circular portion 77. FIG. 4B shows a circular projection element 79 with a central hole 83 surrounded by peripheral holes 81. FIG. 4C shows a circular projection element with a central hole 93, a plurality of triangular portions 91 separated by cut out portions 95.

Figure 5B:
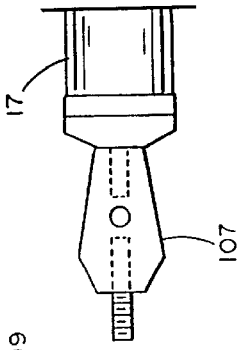
Figure 5C:
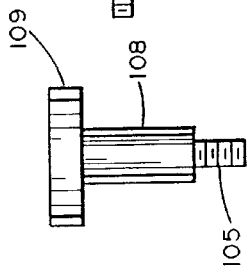
Figure 5A:
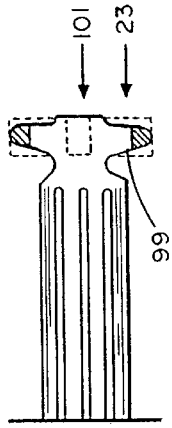
FIG. 5A is a side view of a damping element.
Figure 5D:
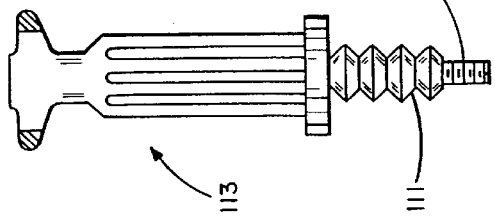

FIG. 5A shows an alternative configurations of the damping element. In FIG. 5A, the second end 23 includes a disk shaped projection 99 and an insert 101 into which additional projection elements may be attached. FIGS. 5B–5F show alternative configurations of the base unit. FIG. 5B shows a base unit 107 that is attached to the damping element 17. A screw portion 105 is used to fasten the base unit 107 to a bow. FIG. 5C shows an alternative shaped base unit with a cylinder shaped bottom portion 108 and a disk shaped top portion 109 that may be attached to a bow with the screw portion 105. FIG. 5D shows an alternative arrangement where the base unit 111 has a screw 105 for attachment to a bow. The base unit 111 is in turn attached to a damping element 113.

Referring to FIG. 6, the damping element 17 is shown. The damping element 17 includes elongated recessed flutes 31. The flutes 31 are configured for accepting the spring rods 19 as shown in FIG. 2. Although the flutes 31 shown in FIG. 2 are recessed flutes, alternative flute arrangements are possible to establish a connection between the rods 19 and the damping element 17. For example, the flutes 31 may be tubes extending lengthwise through the damping element such that the rods 19 may be fitted into the flutes and embedded into the damping element 17. The second end 23 of the damping element 17 preferably extends beyond the length of the recessed flutes. The damping element 17 is attached to the base unit 11 and the archery bow by a second stud 16. The second stud 16 runs lengthwise into the center of the damping element 17.

Referring now to FIG. 7, a cross sectional view of the damping element 17 is shown. The recessed flutes 31 are shown around the circumference of the damping element 17. The second stud 16 extends through the center of the damping element 17. Preferably, the second stud 16 extends only about one half an inch into the center of the damping element.

EXAMPLE 1

The invention will be further illustrated by the following example of a preferred embodiment. Referring to FIG. 2, the damping element 17 is 4.525 inches from the first end 27 to the second end 23. The spring rods 19 extend 3.700 inches from the first end 27 of the damping element 17. The spring rods 19 have a diameter of 0.167 inches. The linear springs 19 are screwed into the absorber mount 13 by a 0.250 inch #10-32 thread portion (not shown).

The absorber mount 13 has a total length of 0.700 inches. The absorber mount 13 has a portion with a diameter of 1.250 inches at the end proximate to the damping element 17 which extends 0.450 inches. The recessed portions 29 in which the rods 19 are inserted and secured have a diameter of 0.167 inches. The end of the absorber mount 13 proximate to the base unit 11 has a diameter of 0.700 inches.

The base unit 11 is 1.560 inches in total length. The base unit has a diameter of 0.700 inches at the each end. The base unit 11 tapers to a maximum diameter of 1.000 inches at a point 0.310 inches from the end distal to the absorber mount 13.

The damping element 17 extends parallel to the rods 19 and tapers at point 51. Point 51 is 3.900 inches from the first end 27 of the damping element 17. The damping element 17 has a diameter from its first end 27 to point 51 of 1.090 inches. The diameter of the damping element at its second end 23 is 0.711 inches. The ribs 21 are 0.125 inches wide. Referring to FIG. 6, the damping element 17 has recessed flutes 31 that are 3.700 inches long extending lengthwise. The second stud 16 extends 1.00 inch from the first end 27 of the damping element 17.

Referring to FIG. 7, the recessed flutes 31 have a diameter of 0.167 inches for receiving the rods 19 as shown in FIG. 2.

EXAMPLE 2

The invention will be further illustrated by the following example of a preferred embodiment.

Figure 8:
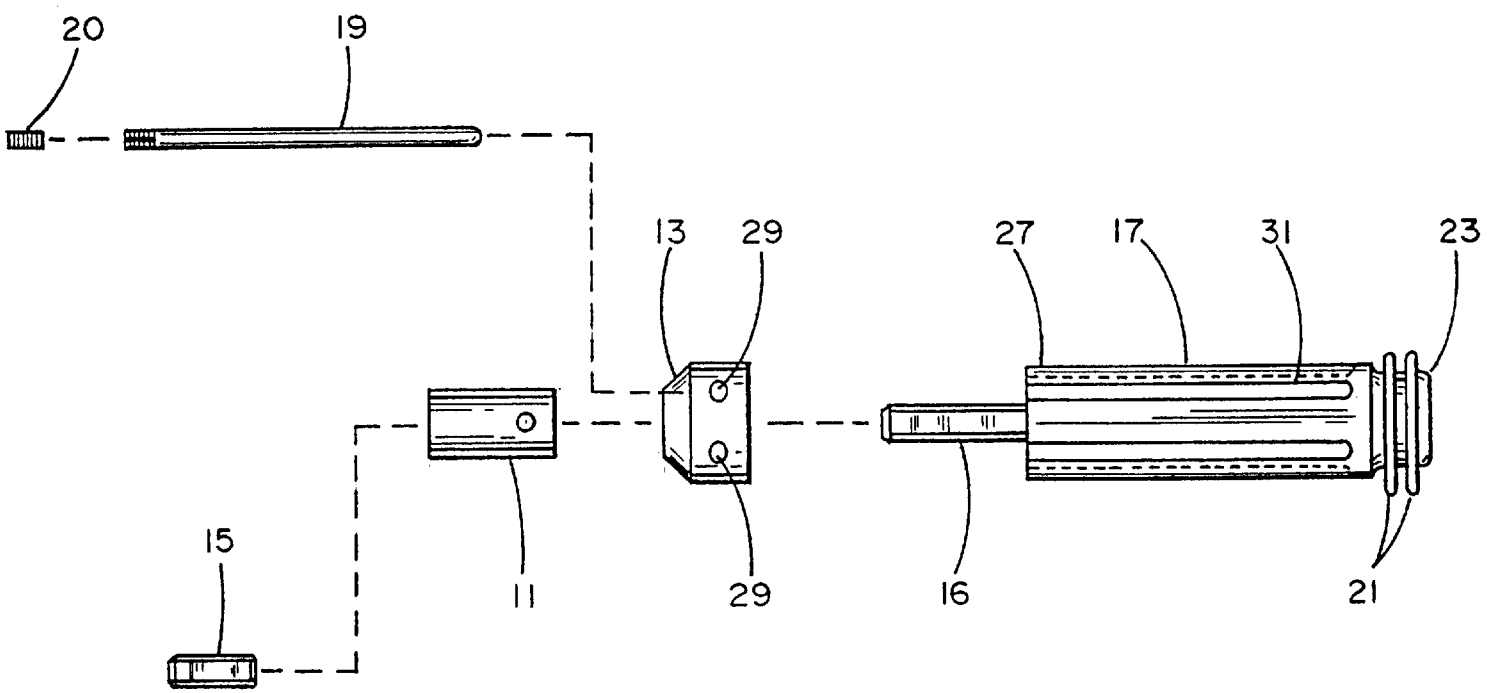
FIG. 8 is a view of a bow stabilizer assembly.

FIG. 8 is a view of the assembly of a bow stabilizer. The damping element 17 is shown with a first end 27, a second end 23, and at least one rib 21 extending radially around the second end 23 of the damping element 17. The damping element is attached to a second stud 16.

The absorber mount 13 is attached to the damping element 17 by the second stud 16. The absorber mount 13 has an insertion hole (not shown) for receiving the second stud 16. The base unit 11 is connectable to the absorber mount 13. The absorber mount 13 includes recessed portions 29. The recessed portions 29 are tapped holes, and a linear spring rod 19 is passed through the recessed portion 29. When assembled, the rod 19 is placed approximately within the recessed flutes 31. A set screw 20 is placed into a recessed portion 29 to secure the rod 19.

A first stud 15 is connectable to the base unit 11 for securing the base unit 11 to the bow. The first stud 15 is a set screw.

EXAMPLE 3

The invention will be further illustrated by the following example of a preferred embodiment.

Figure 9:
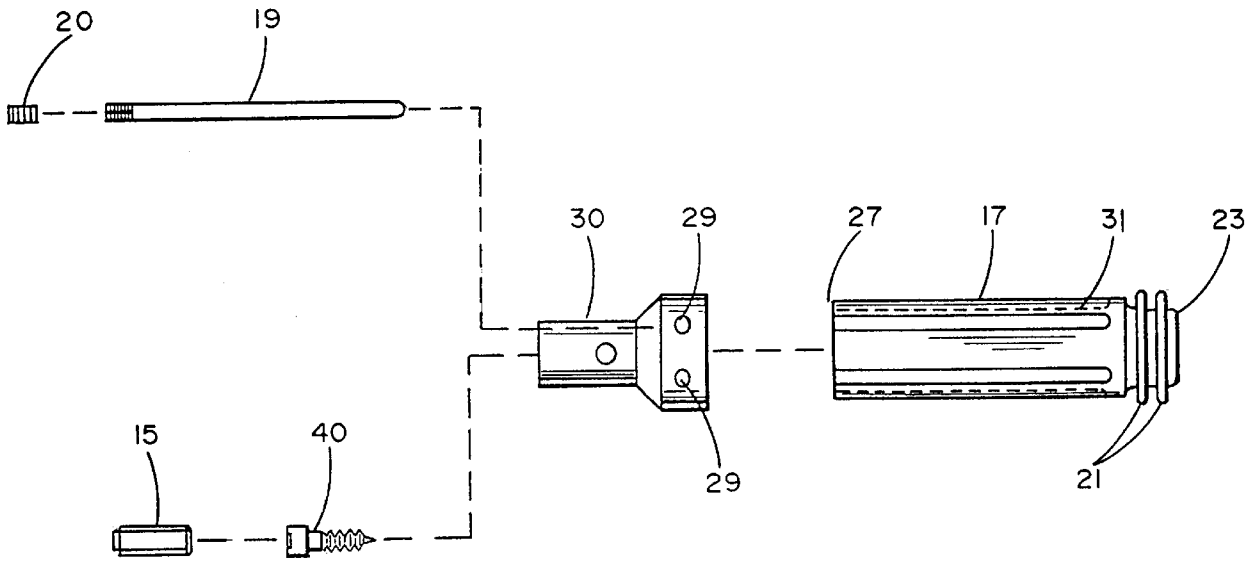
FIG. 9 is a view of an alternative bow stabilizer assembly.

FIG. 9 is a view of a second example of an assembly of a bow stabilizer. The damping element 17 is shown with a first end 27, a second end 23, and at least one rib 21 extending radially around the second end 23 of the damping element 17.

The absorber mount 30 is connectable to the damping element 17 with a cutting thread screw 40. The absorber mount includes recessed portions 29. The recessed portions 29 are tapped holes, and a linear spring rod 19 is passed through the recessed portion 29. When assembled, the rod 19 is placed approximately within the recessed flutes 31. A set screw 20 is placed into a recessed portion 29 to secure the rod 19.

A first stud 15 is connectable to the absorber mount 30 for securing the absorber mount 30 to the bow. The first stud 15 is a set screw. The first stud 15 is connectable directly to the absorber mount 30. The assembly in FIG. 9 does not use a base unit. Instead, the absorber mount 30 functions as an absorber mount and base unit.

It will be appreciated from the above description that the invention may be implemented in other specific forms without departing from the spirit or essential characteristics thereof. The scope of the invention is indicated by the appended claims rather than by the foregoing description and all changes within the meaning and range of equivalency of the claims are intended to be embraced therein.

I claim:

1. An archery bow stabilizer, comprising:

a damping element having a first and second end, wherein said damping element is connectable to an archery bow;

a spring rod; and a flute in communication with said damping element and said spring rod.

2. The archery bow stabilizer of claim 1, wherein said damping element is elongated.

3. The archery bow stabilizer of claim 1, wherein said spring rod is elongated.

4. The archery bow stabilizer of claim 1, further comprising a plurality of spring rods.

5. The archery bow stabilizer of claim 1, wherein said flute extends lengthwise along said damping element from the first end towards the second end, wherein said spring rod is configured to fit within said flute.

6. The archery bow stabilizer of claim 1, wherein said flute comprises a tube extending lengthwise through said damping element from the first end towards the second end, wherein said spring rod is configured to fit within said flute.

7. The archery bow stabilizer of claim 1, wherein said damping element extends beyond the length of said spring rod.

8. The archery bow stabilizer of claim 1, further comprising:

a projection attached to the second end of said damping element.

9. The archery bow stabilizer of claim 8, wherein the projection is removably attached to the second end of said damping element.

10. The archery bow stabilizer of claim 1, further comprising:

one or more ribs extending radially around the second end of said damping element.

11. The archery bow stabilizer of claim 1, further comprising a base unit connectable to an archery bow, wherein said damping element is in communication with said base unit.

12. The archery bow stabilizer of claim 11, further comprising: an absorber mount in communication with the first end of said damping element and said base unit.

13. The archery bow stabilizer of claim 12, wherein said absorber mount comprises aluminum.

14. The archery bow stabilizer of claim 11, wherein said base unit comprises aluminum.

15. The archery bow stabilizer of claim 1, wherein said damping element comprises an elastomeric material.

16. The archery bow stabilizer of claim 15, wherein said elastomeric material is rubber.

17. The archery bow stabilizer of claim 1, wherein said spring rod comprises steel.

18. An archery bow stabilizer, comprising:

a damping element having a first and second end, wherein said damping element is connectable to an archery bow;

a projection attached to the second end of said damping element; and a spring rod in communication with said damping element.

19. The archery bow stabilizer of claim 18, wherein the projection is removably attached to the second end of said damping element.

20. The archery bow stabilizer of claim 18, wherein said projection comprises a weight.

21. An archery bow stabilizer comprising:

a damping element having a first and second end, wherein said damping element is connectable to an archery bow;

one or more ribs extending radially around the second end of said damping element; and a spring rod in communication with said damping element.

22. An archery bow stabilizer comprising:

a damping element having a first and second end, wherein said damping element is connectable to an archery bow;

a base unit connectable to an archery bow, wherein said damping element is in communication with said base unit;

an absorber mount in communication with the first end of said damping element and said base unit; and a spring rod in communication with said damping element.

23. The archery bow stabilizer of claim 22, wherein said base unit comprises aluminum.

24. The archery bow stabilizer of claim 22, wherein said absorber mount comprises aluminum.

25. An archery bow stabilizer, comprising:

a damping element having a first and second end, wherein said damping element is connectable to an archery bow and wherein said damping element comprises a damping element ribbed along its length; and a spring rod in communication with said damping element.

26. An archery bow stabilizer, comprising:

a damping element having a first and second end, wherein said damping element is connectable to an archery bow and wherein said damping element comprises a damping element tapered along its length; and a spring rod in communication with said damping element.

* * * * *